United States Patent [19]

Wahle

[11] 4,046,064

[45] Sept. 6, 1977

[54] FILTER ROD MAKING MACHINE

[75] Inventor: Günter Wahle, Reinbek, Germany

[73] Assignee: Hauni-Werke Körber & Co. KG, Hamburg, Germany

[21] Appl. No.: 683,050

[22] Filed: May 4, 1976

[30] Foreign Application Priority Data

May 14, 1975 Germany ..... 2521391
June 28, 1975 Germany ..... 2528906

[51] Int. Cl.[2] ..... A24C 5/50

[52] U.S. Cl. ..... 93/1 C; 226/195; 242/75.2

[58] Field of Search ..... 93/1 C; 226/195; 242/75.2; 28/59.5, 71.3

[56] References Cited

U.S. PATENT DOCUMENTS

| | | | |
|---|---|---|---|
| 1,445,022 | 2/1923 | Kimball | 242/75.2 |
| 2,341,097 | 2/1944 | Heebink | 242/75.2 X |
| 3,087,224 | 4/1963 | Sapilevsky et al. | 28/59.5 |
| 3,960,645 | 6/1976 | Brackmann et al. | 93/1 C X |
| 3,971,695 | 7/1976 | Block | 93/1 C |

*Primary Examiner*—James F. Coan
*Attorney, Agent, or Firm*—Peter K. Kontler

[57] ABSTRACT

A filter rod making machine wherein the two is withdrawn from a bale by a first pair of driven rolls which form part of a tow stretching device. The rolls are preceded by a braking device having a fixed plate-like guide at one side of the path for the tow and an elastic spring-biased tongue which is located at the opposite side of the path and urges successive increments of the tow against the guide to thereby uniformize or eliminate the crimp of filamentary filter material of the tow. The tongue is pivotable about a fixed axis and can be reciprocated back and forth transversely of the direction of movement of the tow to thereby contribute to loosening of filter material before such material advances beyond the first pair of rolls and is stretched to the elastic limit by a second pair of rolls whose peripheral speed exceeds the peripheral speed of the first pair of rolls. The tension upon the filaments of the tow is thereupon relaxed before the filaments are caused to pass across a spray of atomized plasticizer which causes portions of neighboring filaments to adhere to each other.

13 Claims, 3 Drawing Figures

Fig. 2
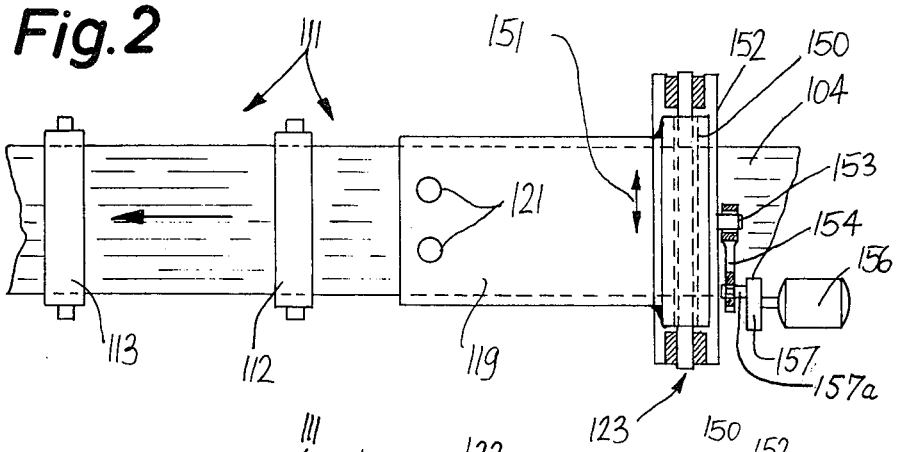
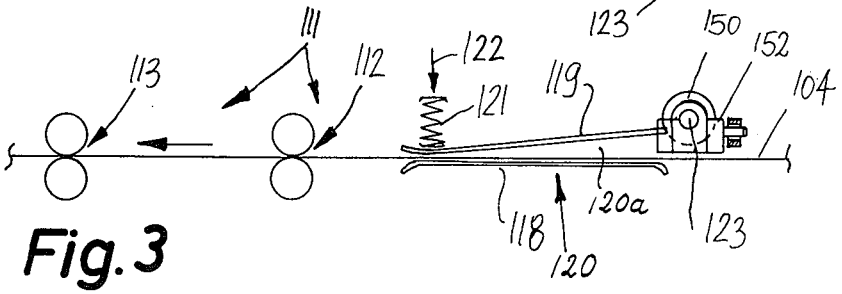
Fig. 3

FILTER ROD MAKING MACHINE

BACKGROUND OF THE INVENTION

The present invention relates to machines for the production of filter rods which can be subdivided into filter mouthpieces for cigarettes, cigars or cigarillos. More particularly, the invention relates to improvements in devices for stretching tows of randomly crimped filamentary filter material in filter rod making machines.

The tow of filter material which is converted into the rod-like filler of a continuous filter rod consists of a very large number of crimped filaments, e.g., fibers made of acetate or another suitable synthetic plastic material. The tow is normally flat and is stored in the form of a highly compacted bale wherein the filaments in successive increments of the tow are crimped to a different extent. This creates problems in connection with the application of plasticizer which is used to bond neighboring filaments to each other in order to enable the filler of the filter rod to form a maze of minute passages for tobacco smoke. As a rule, the tow is withdrawn from the bale in an upward direction and is thereupon lossened (banded), stretched, sprinkled with atomized plasticizer, condensed into a rod-like filler, wrapped into a web of cigarette paper or the like, and subdivided into filter rod sections of desired length.

As mentioned above, the crimp of filaments which form the tow is not uniform. In many instances, the crimp varies within a very wide range so that the quantity of filter material in successive unit lengths of the tow also varies within such wide range. The differences in crimp of successive increments of the tow can be readily observed with the naked eye by looking at the layers of the tow in a bale, i.e., a strongly crimped portion of the tow is preceded or followed by a portion which is substantially free of crimps or by a portion whose crimp is much less pronounced than that of the preceding or next-following portion. On the other hand, it is desirable to insure that each and every unit length of the filler in a filter rod should contain identical quantities of filamentary filter material. The absence of homogeneousness in successive increments of the filler which forms part of a filter rod would cause the filter mouthpieces for cigarettes, cigars or cigarillos to offer a widely different resistance to the flow of tobacco smoke therethrough. Therefore, the manufacturers of filter rods strive to uniformize the tow before the latter enters the rod forming unit.

Presently known filter rod making machines already comprise devices which serve to stretch the tow upstream of the plasticizing station. For example, U.S. Pat. No. 3,224,453 to Mahoney et al. discloses a filter rod making machine wherein the tow passes through several pairs of rolls at least one pair of which is driven to draw the tow from the bale. The remaining rolls bear against the tow and are rotated as a result of frictional engagement with the filaments of the tow. It is also known to drive the first pair of rolls at a relatively low speed and to drive the next-following pair or pairs of rolls at a higher speed so that the filaments are stretched during travel from the nip of a preceding pair of rolls toward the nip of the next-following pair of rolls. It has been found that such arrangement does not suffice to insure satisfactory homogenization of the tow so that each and every increment of the rod-like filler in the filter rod will contain identical quantities of filamentary filter material.

SUMMARY OF THE INVENTION

An object of the invention is to provide a filter rod making machine with novel and improved means for treating the tow in such a way that each and every increment of the tow which is to be converted into a rod-like filler contains identical quantities of filamentary filter material.

Another object of the invention is to provide a novel and improved tow stretching device for use in filter rod making machines.

A further object of the invention is to provide the stretching device with novel and improved means for braking the tow upstream of the plasticizer-applying station of the filter rod making machine.

An additional object of the invention is to provide a stretching device whose homogenizing action is not affected by pronounced differences in the crimp of filamentary filter material forming the tow which is withdrawn from a bale or another source of supply of filter material.

Still another object of the invention is to provide a stretching device which can uniformize the crimp of a tow wherein the crimp varies from increment to increment as well as within each increment of the tow, and whose homogenizing action is not affected by the face that the crimp can fluctuate within a very wide range.

A further object of the invention is to provide a stretching device which is capable of homogenizing and simultaneously enhancing the fluffiness of the tow.

The invention is embodied in a filter rod making machine of the type wherein a continuous tow of randomly crimped filamentary filter material is transported from a bale of another suitable source of supply along a predetermined path toward and into a filter rod making unit wherein the tow is draped into a web of cigarette paper or the like. More particularly, the invention is embodied in a tow stretching device which forms part of the filter rod making machine and comprises a pair of driven rolls or analogous rotary members serving to draw the tow from the source. The stretching device further comprises a braking device which is disposed intermediate the rotary members and the source and includes a preferably plate-like first guide adjacent to one side of the path for the tow and a second guide which is preferably elastic and is adjacent to the other side of the path for the tow opposite the first guide. The second guide yieldably urges the tow against the first guide so that the guides brake the tow and contribute to uniformizing or elimination of crimp in the filamentary filter material.

The stretching device preferably further comprises a second pair of rolls or analogous rotary members which are adjacent to the path downstream of the first mentioned rotary members and serve to stretch successive increments of the tow, preferably to the elastic limit of filamentary filter material. Still further, the stretching device preferably comprises means for rotating at least one rotary member of the first mentioned pair at at least one first speed, and means for rotating at least one rotary member of the second pair at at least one second speed which is different from and is normally higher than the first speed so that the tow is stretched during travel between the two pairs of rotary members.

The second guide is preferably pivotable about a fixed axis and may be biased against or toward the first guide by one or more springs or other suitable biasing means whose bias is preferably adjustable so as to enable the attendants to change the force with which the second guide urges the tow against the first guide. At least one of the guides may be mounted for movement substantially transversely of the direction of movement of the tow; for example, the second guide may be reciprocated transversely of the path by an electric motor through the intermediary of an eccentric and a connecting rod.

The novel features which are considered as characteristic of the invention are set forth in particular in the appended claims. The improved machine itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 2 is a plan view of a portion of a modified machine, with certain parts shown in section; and FIG. 3 is an elevational view of the structure which is shown in FIG. 2.

DESCRIPTION OF THE PREFERRED EMBODIMENTS

Figure 1:
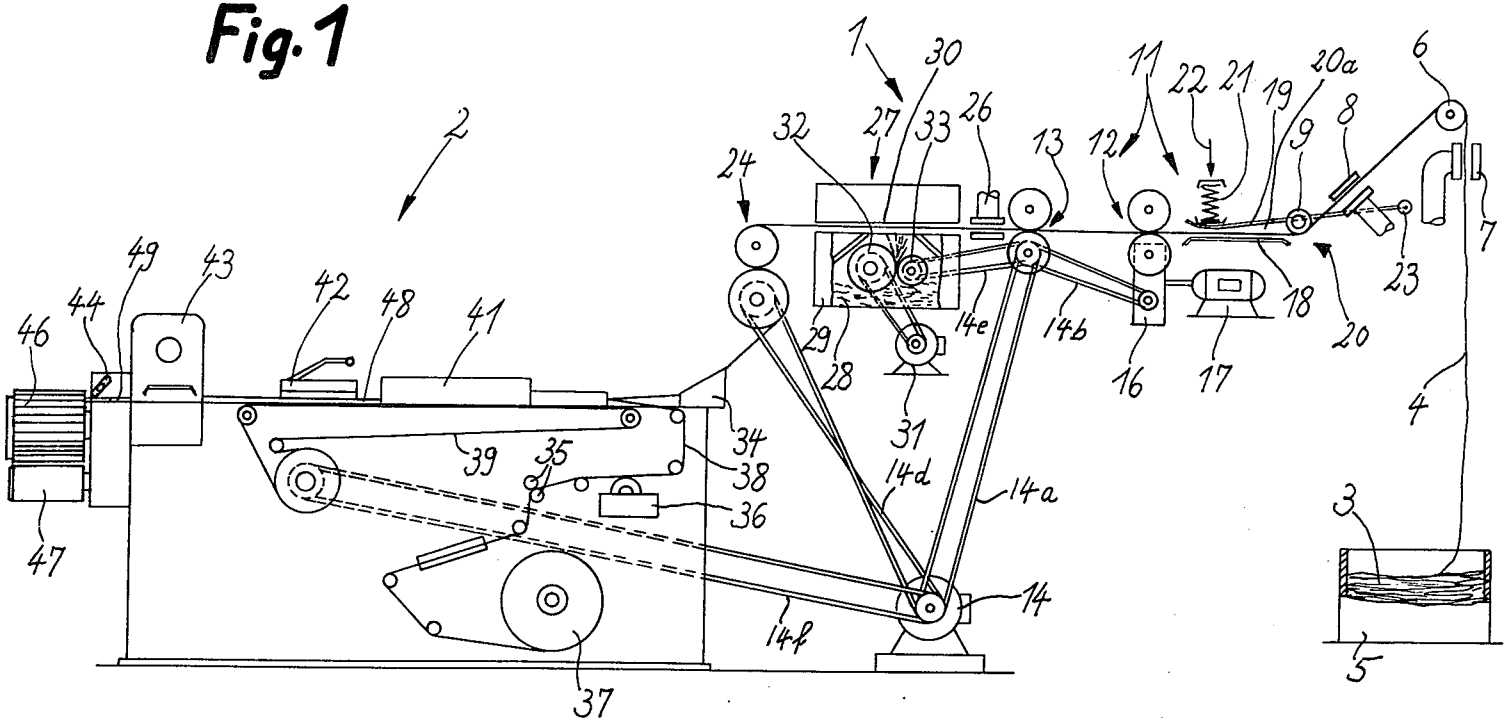
FIG. 1 is a schematic partly elevational and partly sectional view of a filter rod making machine which embodies one form of the invention.

Referring first to FIG. 1, there is shown a filter rod making machine which comprises two main units, namely, a tow processing unit 1 and a filter rod making unit 2.

The tow processing unit 1 comprises a pair of driven rolls or analogous rotary members 12 which draw a continuous tow 4 of filamentary filter material (e.g., acetate fibers) from a bale 3 which is stored in a receptacle 5. On its way from the bale 3 to the rolls 12, the tow 4 passes through a first pneumatic banding device 7, thereupon around a guide roller 6, through a second pneumatic banding device 8, around a second guide roller 9, and through a novel braking device 20. Each of the banding devices 7, 8 comprises a pipe which is connected with a source (not shown) of compressed air and whose discharge end carries a plate with a number of small orifices adjacent to one side of the path for the tow 4, and a plate located opposite the orifice at the other side of such path. The streamlets of air issuing from the orifices loosen the filamentary material of the tow which, as a rule, consists of crimped filaments whereby the extent of crimp normally varies within a wide range, as considered in the longitudinal direction of the tow.

The braking device 20 and the driven rolls 12 form part of a stretching device 11 which further includes two additional driven rolls or analogous rotary members 13 spaced apart from and located downstream of the rolls 12. The lower roll 13 receives motion from a main prime mover 14 of the filter rod making machine (this prime mover may constitute a variable-speed electric motor) through the medium of a belt or chain drive **14*a*. The lower roll 13 drives the lower roll 12 through the medium of a second belt or chain drive 14*b* and a variable-speed transmission 16 whose ratio is adjustable by an electric motor 17. The belt or chain drive 14*b* transmits torque to the input element of the transmission 16 and the output element of this transmission can directly drive and support the shaft for the lower roll 12. The speed of the rolls 12 is less than the speed of the rolls 13 so that the tow 4 is stretched, preferably to the elastic limit of its filaments, during travel across the space between the rolls 12 and 13. In other words, successive increments of the tow 4 which enter the nip of the rolls 13** are at least substantially free of crimp.

The improved braking device 20 includes a stationary plate-like guide 18 which is adjacent to one side of the path for the tow 4 between the guide roller 9 and the driven rolls 12, and a preferably elastic plate-like guide or tongue 19 which is located opposite the guide 18 and is pivotable about the axis of a fixed horizontal pivot member 23. One or more relatively weak helical springs 21 bias the front end portion of the tongue 19 against the upper side of the tow 4. The bias of the spring or springs 21 can be regulated by moving the retainer means for the uppermost convolutions of such springs in or counter to the direction indicated by arrow 22. The elements 18, 19 of the brake 20 define a channel or passage 20a wherein the tow 4 is stretched by undergoing a braking action so that the extent to which the filaments of the tow are crimped is reduced upstream of the rolls 12 due to the fact that the front end portion of the tongue 19 biases the tow against the adjacent portion of the guide 18. The tongue 19 can yield, owing to its elasticity and/or due to the provision of one or more springs 21, so that it does not damage or destroy the filaments when a relatively thick portion of the tow passes through the braking device 20. The elements 18, 19 can be said to form a funnel for the tow 4.

The tow processing unit 1 further comprises a third pair of driven rolls 24 which are located downstream of and are spaced apart from the rolls 13. The rolls 13 are immediately followed by an additional banding device 26 which, in turn, is followed by a conditioning device 27 serving to spray atomized plasticizer 28 (e.g., triacetin) against the filaments of the stretched and loosened tow 4. During travel between the rolls 13 and 24, the tow 4 forms a relatively wide flat strip all or nearly all filaments of which are accessible for the application of atomized plasticizer 28.

The periphery of one of the rolls 12 and 24 is preferably formed with circumferential grooves, and the periphery of the other of the rolls 12 and 24 is preferably the smooth outer surface of an elastic sleeve surrounding a rigid hub of the respective roll. The lower roll 24 receives motion from the prime mover 14 through the medium of a belt or chain drive **14*d***.

The conditioning device 27 comprises a vessel 29 for a supply of plasticizer 28, a withdrawing roller 32 which dips into the supply of liquid in the vessel 29 and removes a thin film of plasticizer, a separate prime mover 31 (e.g., an electric motor) for the withdrawing roller 32, a rotary cylindrical brush 33 which converts the thin film into a spray of finely atomized plasticizer and directs the spray against the underside of the tow 4, and a belt or chain drive 14e which transmits motion from the lower roll 13 to the brush 33. The upper side of the tow 4 preferably travels below and rubs against the underside of a plate-like intercepting device 30 serving to intercept atomized plasticizer which happens to pass through the tow; this contributes to more uniform distribution of plasticizer in successive increments of the tow.

The filter rod making unit 2 comprises a gathering horn 34 which converts the flattened tow 4 into a rod-like filler ready to be wrapped into a web 38 of cigarette paper or other suitable wrapping material. The web 38 is withdrawn from a bobbin 37 by two advancing rollers 35 which receive motion from the prime mover 14 in a manner not shown in FIG. 1, and the underside of the web is coated with adhesive during travel along a paster 36. The web 38 is thereupon engaged and entrained by the upper reach of an endless belt conveyor 39 (known as garniture) which causes the web and the filler to pass through a wrapping mechanism 41. One roller for the conveyor 39 is driven by the prime mover 14 through the medium of a belt or chain drive 14*f*.

The filter rod 48 which issues from the wrapping mechanism 41 thereupon advances along a sealer 42 which heats the seam where the marginal portions of the web 38 overlap each other. The rod 48 is thereupon severed by a cutoff 43 to yield a single file of filter rod sections 49 of desired length. Successive sections 49 are accelerated by a rapidly rotating cam 44 which propels them into successive flutes of a rotary drum-shaped row-forming conveyor 46. The latter converts the single file of filter rod sections 49 into one or more rows wherein the sections move sideways, and such row or rows are transferred onto the upper reach of an endless take-off belt conveyor 47 which transports the sections to storage, to a tray filling apparatus, to a pneumatic sender which propels the sections into the magazine of a filter cigarette making machine, or directly to the filter cigarette making machine.

The operation:

The rolls 12 of the stretching device 11 draw the tow 4 from the bale 3 in the receptacle 5. Successive increments of the tow 4 are loosened during passage through the banding devices 7 and 8. These devices effect a pronounced disentangling of the filaments which, however, need not be complete since the tow thereupon undergoes a pronounced stretching and renewed banding action before it reaches the conditioning device 27.

The rolls 12 also effect a preliminary stretching of the filaments which form the tow 4 because they pull the tow through the braking device 20, i.e., through the passage 20*a* wherein the elastic spring-biased tongue 19 urges the tow against the front end portion of the fixedly mounted guide 18. The elements 18, 19 of the device 20 brake the tow 4 as a result of frictional engagement of their front end portions with the filaments. This results in uniform or nearly uniform elimination or reduction of the crimp with the result that the space between the rolls 12 and 13 contains equal quantities of filamentary filter material per unit of time. Otherwise stated, the space between the rolls 12 and 13 contains straight and substantially or exactly parallel filaments whose stretch is identical or nearly identical which, in turn, insures that identical quantities of filamentary filter material pass through the conditioning device 27 during successive equal intervals of time.

The filaments which are located between the rolls 12 and 13 are subjected to a pronounced stretching action (in addition to the stretching action which takes place while the filaments are drawn by the rolls 12 in order to advance through the passage 20a of the braking device 20) because the peripheral speed of the rolls 13 exceeds the peripheral speed of the rolls 12. It is presently preferred to stretch the tow 4 to the elastic limit of its filaments so that the crimp of filaments disappears, either entirely or practically entirely. Such stretching of filaments to the elastic limit of the material results in further loosening of the tow 4 because the filaments are at least substantially straight.

Once the tow 4 has advanced beyond the rolls 13, the tension of its filaments decreases rather abruptly because the speed of the rolls 24 is less than the speed of rolls 13. Therefore, the crimp of the filaments reappears; however, the crimp is much more uniform than in the tow which is stored in the receptacle 5. This is attributable to repeated loosening (banding), braking (stretching) and tensioning of the filaments. The uniformity of crimp can be readily seen by comparing the tow upstream of the first banding device 7 with the tow downstream of the rolls 13. The abrupt reduction of tension results in readily detectable spreading of the filaments between the rolls 13 and 24 so that the tow is much fluffier than in the receptacle 5. In other words, the tow is in an optimum condition for the application of atomized plasticizer 28. Prior to such application, successive increments of the fluffy tow pass through the additional banding device 26 which effects a further loosening of the tow. The thus loosened tow is contacted by atomized plasticizer 28 which is sprayed by the rapidly rotating brush 33. As mentioned above, the brush 33 atomizes a thin film of plasticizer which is withdrawn by the periphery of the roller 32. The plate 30 intercepts droplets of plasticizer which happen to pass between the filaments of the tow 4 and enables the tow to entrain such droplets toward the rolls 24 so that each and every increment of the tow accepts and retains identical quantities of plasticizer. The tow 4 then advances through the nip of the rolls 24 and enters the gathering horn 34 to be converted into a rod-like filler which reaches the upper side of the web 38 on the upper reach of the garniture 39. The mechanism 41 drapes the web 38 in such a way that one marginal portion of the web overlies the other marginal portion and forms therewith a seam which is thereupon heated by the sealer 42. The adhesive (if any) which is applied between the marginal portions of the web 38 causes the material of the web to adhere to the adjacent portions of the rod-like filler. If the adhesive which is applied by the paster 36 is a hotmelt, the sealer 42 constitutes or includes a cooling device for the seam.

The filter rod 48 includes the filler (tow 4) which is held in compressed condition by the tubular wrapper (web 38), i.e., the filler tends to expand by bearing against the inner side of the tubular wrapper. The cutoff 43 thereupon subdivides the rod 48 into a file of discrete filter rod sections 49 (each of which may be of six or eight times unit length), and such sections are thereupon propelled by the lobe or lobes of the cam 44 so as to enter successive flutes of the row forming conveyor 46. The resulting row or rows of filter rod sections 49 are transferred onto the upper reach of the take-off conveyor 47.

FIGS. 2 and 3 show a stretching device 111 which includes driven rolls 112, 113 and a modified braking device 120 for the tow 104. The peripheral speed of the rolls 113 exceeds that of the rolls 112 so that the filaments of the tow 104 are stretched to the elastic limit of their material during travel between the rolls 112 and 113. The peripheral speed of the rolls 112 and/or 113 can be regulated in a manner not shown in FIGS. 2 and 3, e.g., by resorting to components 16, 17 of the machine shown in FIG. 1.

The braking device 120 comprises a fixed plate-like guide 118 which is located below the path for the tow 104 and an elastic plate-like guide or tongue 119 which is located above such path opposite the guide 118. The width of the channel or passage 120*a* between the guides 118, 119 decreases in the direction of travel of the tow 104 toward the nip of the rolls 112. The front portion of the elastic guide 119 is biased downwardly toward the front portion of the fixed (and preferably but not necessarily rigid) guide 118 by one or more relatively weak helical springs 121 whose bias can be regulated by moving their retainers in or counter to the direction indicated by arrow 122.

The guide 119 is pivotable about the axis of a fixed pivot member 123. In addition, the guide 119 is reciprocated transversely of the direction of movement of the tow 104 (see the doubleheaded arrow 151 in FIG. 2). To this end, the rear portion of the guide 119 is movable back and forth with a slide or carriage 150 which is guided in a stationary bearing member 152. The pivot member 123 for the rear portion of the guide 119 is preferably mounted in and reciprocates with the carriage 150. The latter is reciprocated by a motor 156 through the medium of a disk 157 which is mounted on the output shaft of the motor and has an eccentric pin 157*a* connected to one end of a connecting rod 154 the other end of which is connected to a pin 153 rigid with the carriage 150.

It is clear that the illustrated reciprocating means constitutes but one of many devices which can be used to move the tongue or guide 119 in directions indicated by the arrow 151. For example, the guide 119 can be reciprocated by a vibrator or by a double-acting cylinder and piston unit. Also, the stretching device 111 may comprise means for moving the guide 118 and/or the tongue 119 transversely of the direction of movement of the tow 104.

The operation of a filter rod making machine which embodies the structure of FIGS. 2 and 3 is as follows:

The rolls 112 draw the tow 104 from a bale or another suitable source of supply (not shown) in a manner as illustrated in FIG. 1 whereby the tow passes through one or more banding devices on its way toward the passage 120*a* between the guides 118, 119 of the braking device 120. The front portion of the elastic guide 119 urges successive increments of the tow 104 against the front portion of the fixed guide 118 so that the filaments of the tow are frictionally engaged by the guides and are stretched intermediate the braking device 120 and the rolls 112. The braking action suffices to uniformize the crimp of filaments by effecting a partial or complete elimination of the crimp. This insures that the space between the rolls 112 and 113 receives equal quantities of filamentary filter material per unit of time.

The feature that the guide 118 and/or 119 is reciprocated transversely of the tow 104 contributes to uniformity of friction between the tow and the guides 118, 119 as well as to loosening of the tow due to repeated back-and-forth movements of the guide 119 with the carriage 150. The tow 104 is thereupon stretched to the elastic limit of its filaments because the peripheral speed of the rolls 113 is higher than that of the rolls 112. In other words, the crimp disappears in its entirety and the tow 104 undergoes an additional pronounced loosening action because the filaments are parallel to each other during travel between the rolls 112, 113, i.e., the filaments which remained interlaced with each other in the space between the braking device 120 and the rolls 112 become separated to form a flat layer whose filaments are permitted to contract as soon as they advance beyond the rolls 113 because the peripheral speed of the next-following advancing rolls (corresponding to the rolls 24 of FIG. 1) is less than that of the rolls 113. As a rule, at least the major part of the crimp reappears; however, the crimping of filaments is much more uniform than in the bale because of the banding, braking and stretching actions to which the filaments are subjected during travel from the bale to the nip of the rolls 113. As explained in connection with FIG. 1, abrupt relaxation of tension upon the filaments downstream of the rolls 113 results in a desirable fluffing of the tow 104 on its way toward and through the conditioning device where the filaments are sprinkled with atomized plasticizer. The manner in which the tow is thereupon converted into the rod-like filler of a filter rod and the manner in which the rod is converted into filter rod sections of desired length is preferably the same as described in connection with FIG. 1.

An important advantage of the improved stretching device and its braking means is that the filaments of the tow are subjected to a predictable tensioning, loosening and fluffing action and that the crimp of filaments which pass through the conditioning device is much more uniform than in heretofore known machines. Moreover, the predictable and reproducible treatment of filamentary filter material is achieved in a simple and space-saving manner. The stretching device further insures that each and every filament (or practically all filaments) can be stretched to the elastic limit during travel between the rolls 12, 13 or 112, 113 irrespective of the nature of crimp in the tow which is being withdrawn from the bale. Thus, the filaments are invariably stretched to the elastic limit of their material regardless of whether the crimp of the tow upstream of the braking device 20 or 120 is uniform or varies from increment to increment of the tow as well as from filament to filament in any given increment of the tow.

The uniformity of crimp of the filaments which advance beyond the rolls 13 or 113 is further attributable to the fact that the stretching action takes place in two stages, i.e., first between the braking device 20 or 120 and the rolls 12 or 112, and thereupon between the rolls 12, 13 or 112, 113. The extent of stretching in each stage can be varied by changing the speed of the rolls 12 or 112 with respect to the speed of the rolls 13 or 113, or vice versa.

The uniformity of stretching action in the first stage can be enhanced by mounting one or both guides of the braking device for movement transversely of the direction of movement of the tow. Such movements of one or both guides contribute to more uniform frictional engagement between the guides and the filaments which pass through the braking device. Furthermore, the oscillating guide or guides contribute to a highly desirable loosening action immediately or shortly before the filaments reach the space between the rolls 12, 13 or 112, 113, i.e., the main stretching zone.

Without further analysis, the foregoing will so fully reveal the gist of the present invention that others can, by applying current knowledge, readily adapt it for various applications that, from the standpoint of prior art, fairly constitute essential characteristics of the generic and specific aspects of my contribution to the art and, therefore, such adaptations should and are intended to be comprehended within the meaning and range of equivalence of the claims.

What is claimed is:

1. In a filter rod making machine wherein a continuous tow of randomly crimped filamentary filter material is transported from a source of supply along a predetermined path toward and into a filter rod making unit, a tow stretching device comprising two pairs of rotary members driven at different speeds arranged to draw the tow from said source and to simultaneously stretch said tow; and a tow braking device adjacent to said path intermediate said rotary members and said source, said braking device including a first guide adjacent to one side of said path and a second guide adjacent to the other side of said path opposite said first guide and arranged to yieldably urge the tow against said first guide with a substantially constant force so as to furnish a substantially constant braking action for each increment of the tow passing between said guides.

2. A stretching device as defined in claim 1, wherein said second guide is elastic.

3. A stretching device as defined in claim 2, further comprising a second pair of rotary members located downstream of and arranged to draw the tow beyond said first mentioned rotary member, means for rotating said first mentioned pair of rotary members at at least one first speed, and means for rotating said second pair of rotary members at at least one different second speed.

4. A stretching device as defined in claim 2, wherein said first guide is a fixedly mounted plate.

5. A stretching device as defined in claim 2, wherein said second guide is pivotable with respect to said first guide and said braking device further comprises pivot means for said second guide.

6. A stretching device as defined in claim 5, wherein said pivot means defines a fixed pivot axis for said second guide.

7. A stretching device as defined in claim 5, further comprising means for biasing said second guide against the tow intermediate said guides.

8. A stretching device as defined in claim 7, wherein said biasing means comprises at least one spring.

9. A stretching device as defined in claim 2, wherein said guides define for the tow a passage whose width decreases in a direction toward said rotary members.

10. A stretching device as defined in claim 1, further comprising means for moving at least one of said guides substantially transversely of the direction of movement of the tow along said path.

11. A stretching device as defined in claim 10, wherein said means for moving said one guide includes means for reciprocating said one guide transversely of said path.

12. A stretching device as defined in claim 10, wherein said one guide is said second guide and at least a portion of said second guide consists of elastomeric material.

13. A stretching device as defined in claim 1, further comprising means for adjusting the force with which said second guide urges the tow against said first guide.

* * * * *